US007698878B2

(12) United States Patent
Meshberg

(10) Patent No.: US 7,698,878 B2
(45) Date of Patent: Apr. 20, 2010

(54) AEROSOL CONTAINER WITH INTEGRAL MOUNTING CUP AND ANTI-CLOG VALVE

(75) Inventor: Philip Meshberg, Palm Beach, FL (US)

(73) Assignee: Dispensing Patents International, LLC, Boynton Beach, FL (US)

( * ) Notice: Subject to any disclaimer, the term of this patent is extended or adjusted under 35 U.S.C. 154(b) by 379 days.

(21) Appl. No.: 11/359,449

(22) Filed: Feb. 23, 2006

(65) Prior Publication Data

US 2007/0181608 A1 Aug. 9, 2007

Related U.S. Application Data

(60) Provisional application No. 60/726,646, filed on Oct. 17, 2005.

(51) Int. Cl.
*B65B 31/00* (2006.01)

(52) U.S. Cl. ..... 53/470; 53/403; 53/452; 53/471; 222/402.1

(58) Field of Classification Search ..... 53/403, 53/452, 467, 470, 471; 222/402.1, 402.2, 222/394

See application file for complete search history.

(56) References Cited

U.S. PATENT DOCUMENTS

| | | | | |
|---|---|---|---|---|
| 2,974,453 | A * | 3/1961 | Meshberg | 53/470 |
| 3,174,659 | A * | 3/1965 | Sorber et al. | 222/394 |
| 3,254,677 | A * | 6/1966 | Wakeman | 222/394 |
| 3,336,720 | A * | 8/1967 | Honisch | 53/470 |
| 3,371,460 | A * | 3/1968 | Rait | 53/470 |
| 3,406,877 | A * | 10/1968 | Frangos | 222/402.1 |
| 3,415,425 | A * | 12/1968 | Knight et al. | 222/402.2 |
| 3,497,112 | A | 2/1970 | Samuelson | |
| 3,672,117 | A | 6/1972 | Shuttleworth et al. | |
| 3,718,236 | A * | 2/1973 | Reyner et al. | 222/402.1 |
| 3,795,137 | A | 3/1974 | Lo et al. | |
| 3,933,206 | A * | 1/1976 | Burke | 222/402.14 |
| 3,981,119 | A | 9/1976 | Schultz | |
| 4,073,398 | A * | 2/1978 | Schultz | 215/253 |
| 4,350,272 | A * | 9/1982 | Petterson | 53/470 |
| 5,445,680 | A | 8/1995 | Hamilton | |
| 5,667,104 | A | 9/1997 | Meshberg | |
| 5,915,595 | A | 6/1999 | Dow et al. | |
| 6,080,823 | A | 6/2000 | Kiriazis | |
| 6,394,364 | B1 | 5/2002 | Abplanalp | |
| 2002/0020721 | A1 * | 2/2002 | Bonningue et al. | 222/402.1 |

* cited by examiner

*Primary Examiner*—Louis K Huynh
(74) *Attorney, Agent, or Firm*—Kenyon & Kenyon LLP

(57) ABSTRACT

An aerosol dispenser is formed from a metal drawn container with an open bottom and a mounting cup structure integrally formed in its top. A bottom piece is attached to the open bottom with a double seam and a dispensing device held in the mounting cup structure. In one embodiment the dispensing device is an anti-clog valve designed to clear all dispensing passages after each operation.

27 Claims, 12 Drawing Sheets

AEROSOL CONTAINER WITH INTEGRAL MOUNTING CUP AND ANTI-CLOG VALVE

This application claims the priority of provisional application 60/726,646 filed Oct. 17, 2005.

The present invention relates to aerosol containers in general and more particularly to an aerosol container in which the mounting cup that supports an aerosol valve is formed integrally with the drawn container and in which the valve is an anti-clog valve.

The conventional container used for aerosol dispensers for many years includes a steel can with a standard 1 inch opening at the top as shown in FIG. 1. The bottom of the can is closed by means of a bottom piece that is attached by double seaming, a method that has been proven to be satisfactory over the years. Although generally made with a seam on the side, such cans or containers may also be integrally formed in one piece (other than the bottom) using a drawing process to avoid the additional seam on the side of the container. The can is formed with a neck terminating in a bead with a one inch opening.

A valve for dispensing, either a standard continuous aerosol spray valve or a metering valve (or hand operated pump) which controls the amount of product to be dispensed is mounted in the 1 inch opening using a mounting cup as shown in FIG. 2. This is accomplished by crimping the mounting cup to the bead at the opening, the valve or pump, in turn, being crimped into the mounting cup.

The empty container normally is printed on the outside with label specified by customer, usually the marketer. Most containers have a protective coating on the internal wall to resist corrosion and meet F.D.A. approval standards. The metal mounting cup for the one inch valve should have a protective coating similar to the internal coating on the container. The empty container is typically shipped to the facility that formulates the product. There the product is filled into the container through the one inch opening, after which the valve in its mounting cup is crimped into position to result in the structure of FIG. 2. Current practice is for the marketing company which has specified the particular aerosol valve or hand operated pump to also specify the empty container. The marketer or the company that does the filling of product buys the valve from the valve supplier. The valve and container have to be received and inventoried by the company responsible for the filling. After the filling operation the filled unit is shipped to a distribution center.

Containers and valves are shipped from separate facilities with essential information to be inventoried and so as to be available to be scheduled for the filling operation. After the filled container is passed through a hot water bath to test for leaks, an actuator and a protective closure are put in place on the dispenser. The product is put in cartons and shipped to a marketer or distribution center.

Although a drawn container is an improvement over seamed containers, this construction still requires both crimping a valve so as to be sealed within the mounting cup and also crimping and sealing the mounting cup to the opening in the can. In addition to the number of steps involved, problems can arise because of dissimilar metals in the can and mounting cup. This can lead to corrosion unless additional coatings are applied. As a way to avoid these problems, there have been proposals in the past to effectively form structure equivalent to the mounting cup in the top of the drawn can. However, previous designs have not taken full advantage of cost savings that can be achieved with such a construction.

Another problem in the art is that of dispensing materials containing powders or other ingredients that tend to clog at the valve seat. Propellants used to expel the product from the closed container have a liquid phase and a vapor phase that forces the product out of the container via a valve supplied by a dip tube, when the valve opens. Most valves utilize a rubber sealing disc to seal the valve outlet when not in use. When the valve is operated, the product passes through an orifice to a passageway in the stem bypassing the sealing disk. When the valve is closed some of the product settles around the valve orifice and can dry over a period of time. If not at the valve orifice, then these deposits sometimes accumulate in the passages of the valve stem and actuator. Drying within the valve body can also occur.

To overcome this problem current valves have vapor taps to open clogs by turning the package upside down and actuating the valve causing the gas in the vapor phase to clear it out.

U.S. Pat. No. 6,247,613 provides an anti-clog actuator and prevents product residue from clogging in the actuator orifices but does not prevent clogging at the valve seat.

Thus, there is a need for an improved container with a simplified method of construction and method of filling such a container that is more economical. Further there is a need of an improved valve that does not clog and a container containing such a valve.

DETAILED DESCRIPTION

Figure 1:
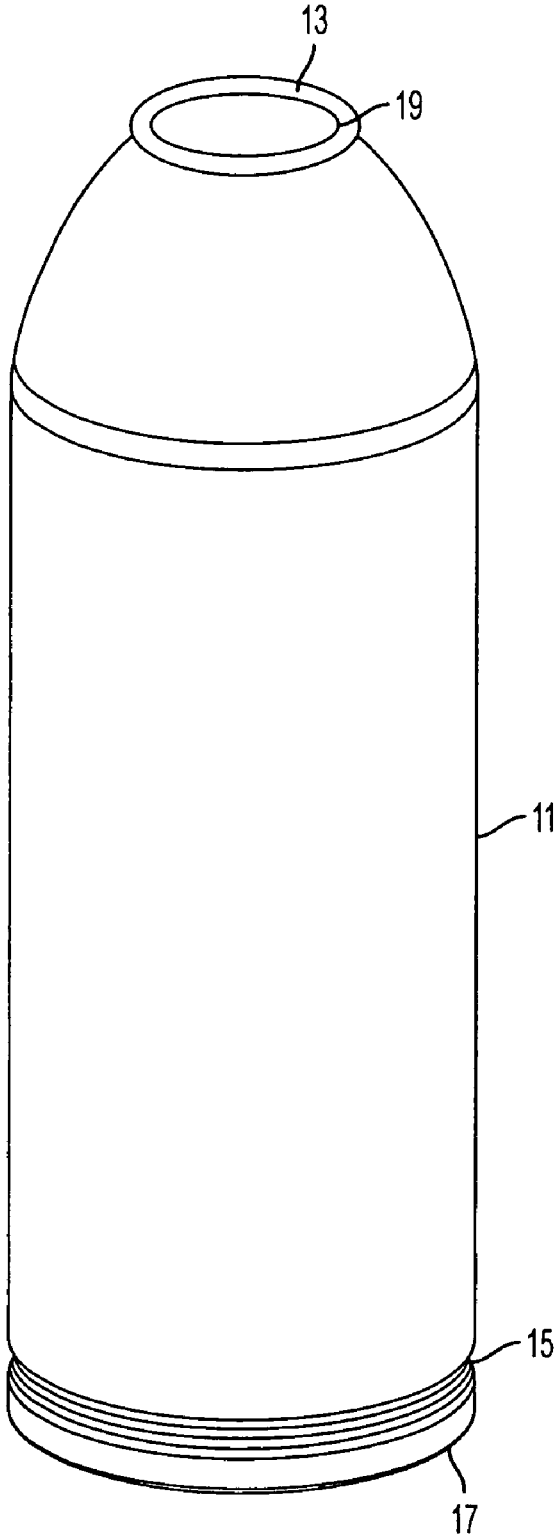
FIG. 1 PRIOR ART
FIG. 1 is a perspective view of a drawn steel can with a 1 inch opening.

A conventional metal can or container 11 with standard 1 inch opening 13 is shown in FIG. 1. The can is made, for example of drawn aluminum or steel and is sealed at the bottom by a double seal 15 attaching a bottom piece 17. The one inch opening 13 at the top contains a bead 19 to receive a mounting cup with a valve, which is crimped to the opening with a sealant between the bead 19 and the mounting cup.

Figure 2:
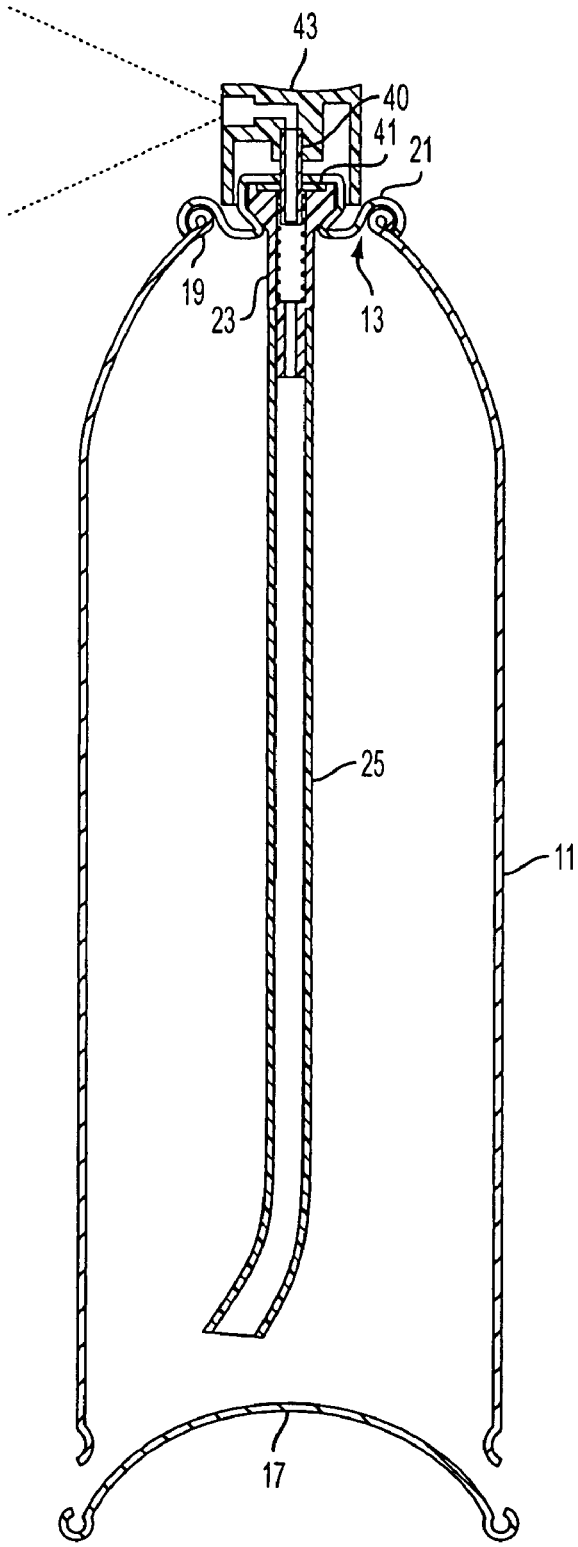
FIG. 2 PRIOR ART
FIG. 2 is a cross-sectional view of the can of FIG. 1 with an attached mounting cup and aerosol valve.

FIG. 2 is cross-sectional view of the can 11 of FIG. 1 with an attached mounting cup 21 and aerosol valve 23. The can 11 is drawn in one piece with an open bottom to accept a conventional bottom piece 17, shown separated from the bottom. The mounting cup 21 containing valve 23, around which the mounting cup 21 is crimped in a sealed manner, is itself crimped to the bead 19 at the opening 13 in the can with a sealant between the bead 19 and mounting cup 21 to form a finished container once the bottom 17 is attached. The finished container is shown with an actuator 43 mounted to the stem 40 of the valve 23, which projects through a sealing washer or gasket 41. The valve is shown in the operated position. A dip tube 25 extends from the bottom of valve 23 to the bottom of the container to supply product to the inlet of the valve.

Such containers are well known and are used for dispensing various products after the container has been filled, and assuming dispensing is via an aerosol valve, pressurized. The can may be coated on the inside to avoid reaction with the product and decorated on the outside to identify the product it contains. One problem with such a container is the need to both crimp the valve into the mounting cup and to crimp the mounting cup to the container. In addition, the container and mounting cup are often of dissimilar metal, which can lead to corrosion unless further steps are taken, such as applying a coating to the inside of the mounting cup.

Figure 3:
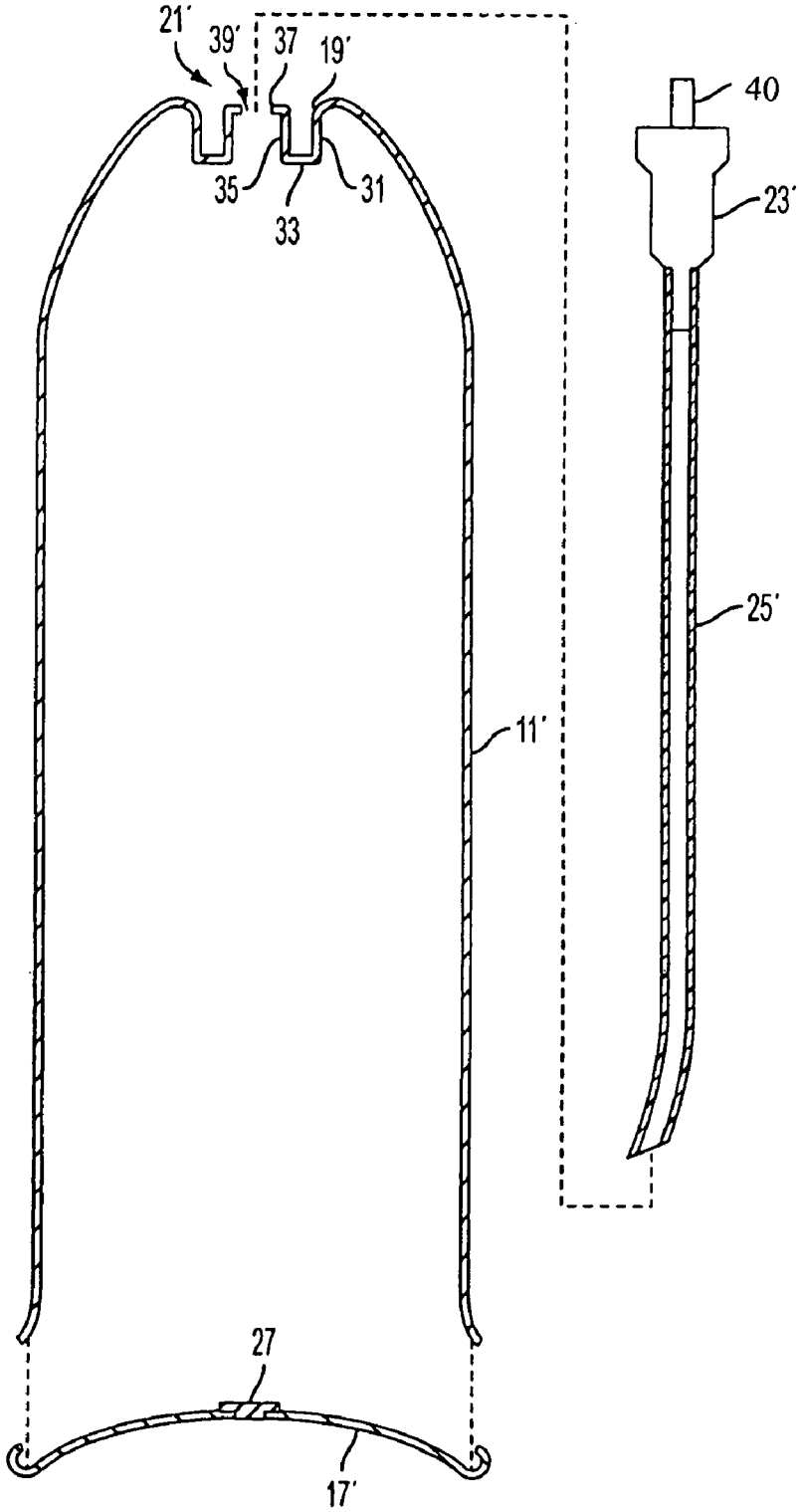
FIG. 3 shows an exploded cross section of a first embodiment of an aerosol container according to the present invention.

FIG. 3 is an exploded cross section of an embodiment of an aerosol dispenser according to the present invention. The metal drawn can or container 11' can be fabricated from any available metal that can be drawn, for example, by means of a plunger press typically used in multiple stages for forming a container or receptacle out of aluminum. In the first step, a dome is formed, followed by formation of the mounting cup structure 21'. A series of drawing steps follow to form the cylindrical container. The final step is that of trimming the bottom. Such processes are known in the art and, thus are not described in detail. If steel is used, it may be tin plated or coated on the inside with a protective coating to resist corrosion or any reaction with the product to be dispensed. Thus, the container 11' after it is fabricated, as is known in the art, can be internally coated with a protective lining and also decorated externally. Typically the material contained in such dispensers will be dispensed under pressure of a gas, which under pressure is liquefied. However, it is also possible to carry out dispensing with pressure developed by other means, such as pumps. Shown separated from the can 11' is the bottom 17' which can be attached with a conventional double seal as in the embodiment of FIGS. 1 and 2. The bottom 17', in this embodiment has an opening into which a one-way check valve 27 is inserted.

The top of the can 11', instead of having the 1 inch openings is shaped to accept an aerosol valve 23' (or a pump). Thus, at the diameter 19', at about the spot where the prior art had a bead, there is provided a cylindrical axially inwardly extending portion 31. Extending radially inward from portion 31 is a portion 33, from which a portion 35 extends axially outwardly to a radially inwardly extending portion 37. This structure formed when fabricating the can provides a special opening or built-in mounting cup 21', for accepting the aerosol valve 23' shown alongside the can 11', along with its attached dip tube 25.' Valve 23' may be a conventional valve, metered or continuous that can be crimped into the special opening 21' either by the container supplier or the marketer of the product. In particular, a valve such as that shown in FIG. 6 or 7 may be used. Alternatively, valve 23' may be a finger operated pump. Typically, such valves or pumps are made of plastic, as with the embodiment of FIG. 7, and there is no need to be concerned about their reacting with the metal of the container 11'.

Figure 4A:
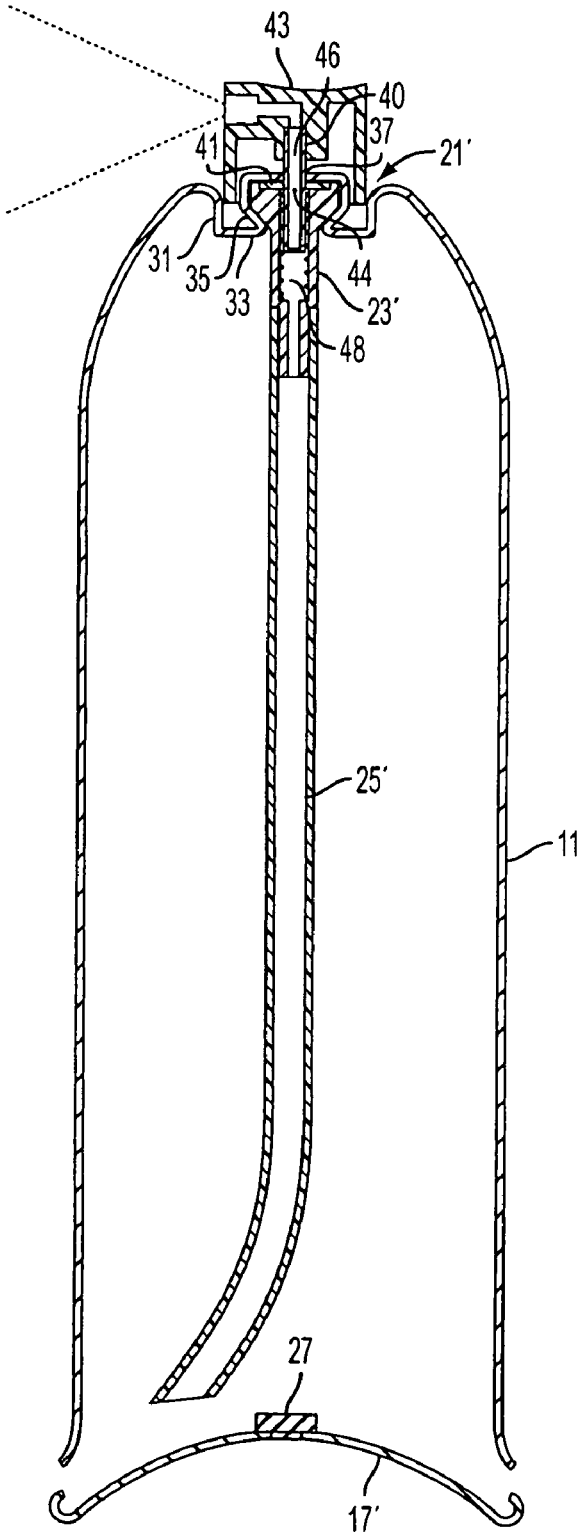
FIG. 4A is a cross-sectional view of the assembled first embodiment of the aerosol container according to the present invention.

FIG. 4A shows the valve 23' crimped in place in the special opening 21'. It is inserted until the top of the valve abuts against portion 37, with the valve stem 40 extending through the opening 39. A gasket 41 seals against the stem 40 and also seals against portion 37. The portions 31, 33, and 35 are deformed by crimping so that portion 35, in particular, conforms to the shape of the valve 23' to hold it in place, pressing gasket 41 against portion 37. An actuator 43 of conventional design is attached to the valve stem 40 to press it axially inwardly to dispense material in the form of a spray from the finished dispenser. In this view, a conventional valve is shown in the operated position.

Figure 4B:
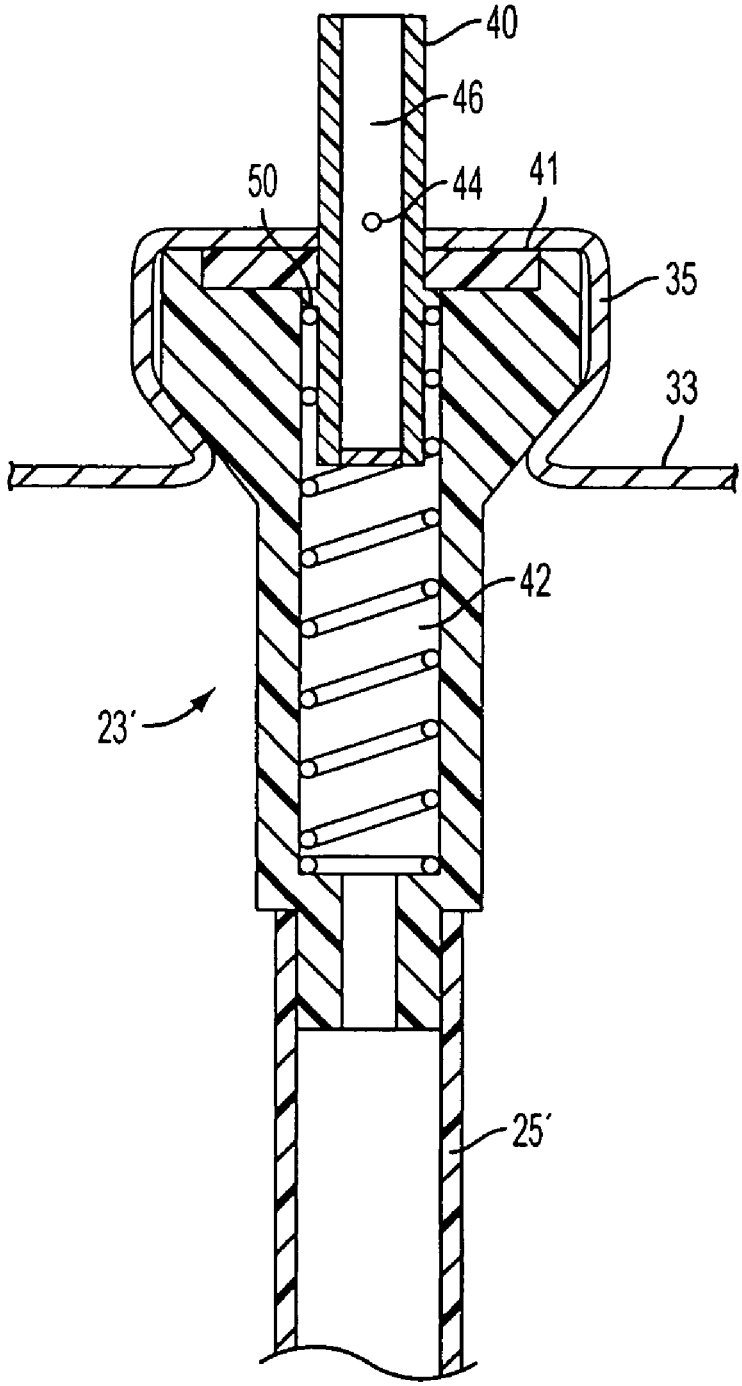
FIG. 4B is a cross-section of a conventional valve that may be used in the embodiment of FIG. 4A.

The valve 23' is shown in the unoperated position in FIG. 4B. In this position, a radial inlet port 44 leading to a passageway 46 formed in the valve stem 40 is above the gasket 41, which seals around the valve stem 40. The pump body or tank 42 is filled with material to be dispensed, since it is in communication with the container via the dip tube 25'. The stem is biased outwardly by a spring 48 acting between the bottom of the tank 42 and an annular flange 50 on the valve stem 40. The inner end of passageway 46 in stem 40 is sealed from the tank.

In operation, the stem 40 is pressed inwardly by an actuator (not shown) causing the inlet port 44 to pass through the gasket 41 into the tank 42 allowing material under pressure to flow out through the passageway 46. Upon release of the stem 40, it returns to the position shown to cut off the flow.

Many existing products can benefit from the advantage of eliminating the problem of corrosion which occurs when using the standard 1 inch valve in which a metal mounting cup must be protectively coated to be compatible with the metal container. This advantage results in further cost reduction beyond that of eliminating a part and the additional crimping step. The valve, which, as noted above, is typically made of plastic and includes a body and dip tube, can be supplied to the marketer of the product being dispensed who can then crimp it in place.

In one method of use, after filling the container, the bottom 17' is doubled seamed to the open bottom of the can 11'. The product can be cold filled with propellant mixture before attaching the bottom, or the bottom can be fitted with the one way valve 27 through which gas may be admitted to pressurize the container at a later date, any time, anywhere.

If the type of valve shown in FIG. 4B is used with a powder, for example, clogging in the passageway 46, at the inlet port 44, and for that matter in the tank 42 which remains filled with material is possible. Thus, an embodiment of the present invention provides an embodiment of a continuous flow valve with an orifice outside the seal, which eliminates clogging by insuring that no residue remains in the valve stem.

The valve and actuator of FIG. 4A are shown in a depressed position. In this position, an inlet port or orifice 44 is below the gasket or seal 41 so that material supplied by the dip tube 25 reaches a passageway 46 in the valve stem 40 to allow it to flow to the actuator 43 and be dispensed. If a powdery material such as starch is being dispensed, after operation, the orifice 44 or passageway 46 may become clogged. As noted above, in this valve, shown in the unoperated position in FIG. 4B, the valve body or tank is always open to the container contents via the dip tube 25'. When operated, the inlet port 44 enters the tank 42 and material under pressure can flow through the outlet passage 46. However, when it is released, the stem returns to the position shown in FIG. 4A and material can remain in the passage 46 and or orifice 44.

Figure 5:
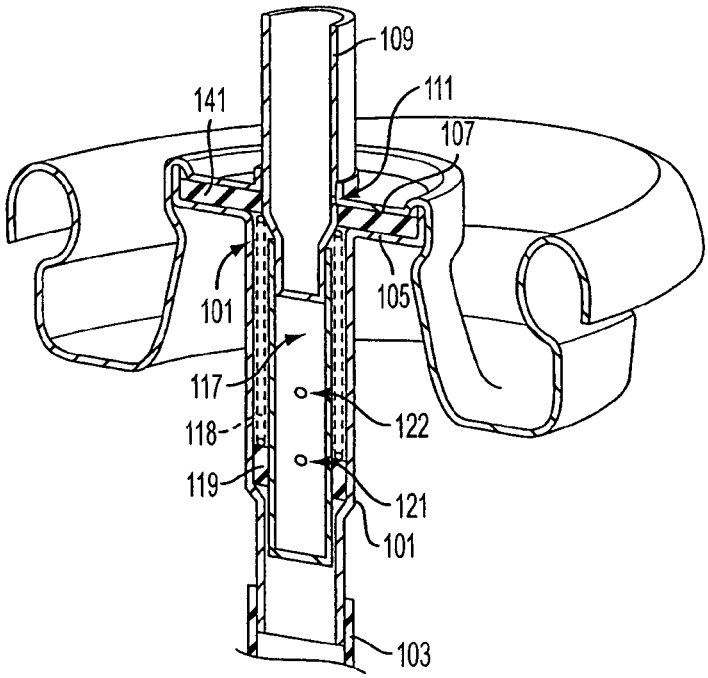
FIG. 5 is a perspective cross sectional view of a first embodiment of an anti-clog dispensing valve according to the present invention mounted in a mounting cup.
Figure 6:
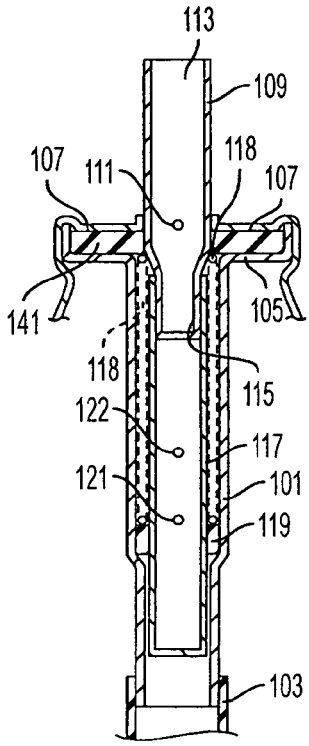
FIG. 6 is a cross sectional view of the first embodiment of the anti-clog dispensing valve according to the present invention mounted directly in an embodiment of a container according to the present invention.

The anti-clog valve of the present invention avoids this problem. In this arrangement, the residue is cleared by vapor after the product is expelled. A first embodiment of such a valve is shown in FIGS. 5 and 6. FIG. 5 shows the valve in a mounting cup and FIG. 6 shows it crimped in a container such as that of FIG. 3. The valve has a housing 101 with an attached dip tube 103. Housing 101 had an enlarged annular portion 105 at its outer end. Gasket or seal 141 forming a valve seat is disposed between the portion 105 and portion 107 of the top of the can. The valve has a two piece stem. Upper stem 109 is a hollow cylindrical member with an orifice or port 111 leading to a discharge passage 113. Its inner end 115 is of a smaller diameter and is inserted into lower stem part 117. Lower stem part 117, closed at its inner end, extends through a seal 119 at the bottom on the housing or tank 101. This prevents the liquid from entering the hollow space in the lower stem part 117. Liquid from the dip tube 103 is prevented from filling the housing 101, because the lower stem part 117 seals against inlet seal 119. The two piece stem is biased outwardly by a spring 118.

When the stem 109 is depressed by an actuator (not shown) a bottom stem orifice 121 bypasses inlet housing seal 119 and product passes through hollow stem part 117 and then through an orifice 122 to the housing. From the housing it reaches the orifice 111, which is now below the seal 107 and passes into the passage 113 to be dispensed through the actuator. When the actuator is released the stem is returned to its rest position, the position shown in the Figures. The orifice 121 is closed before the orifice 111 passes through the seal 107. As a result, the vapor phase remaining in the tank will clean out any powder or residue remaining in the valve orifices before the orifice 111 passes through the seal 107 to reach its rest position outside the seal 107. Furthermore, the housing 101 will be empty.

Figure 7:
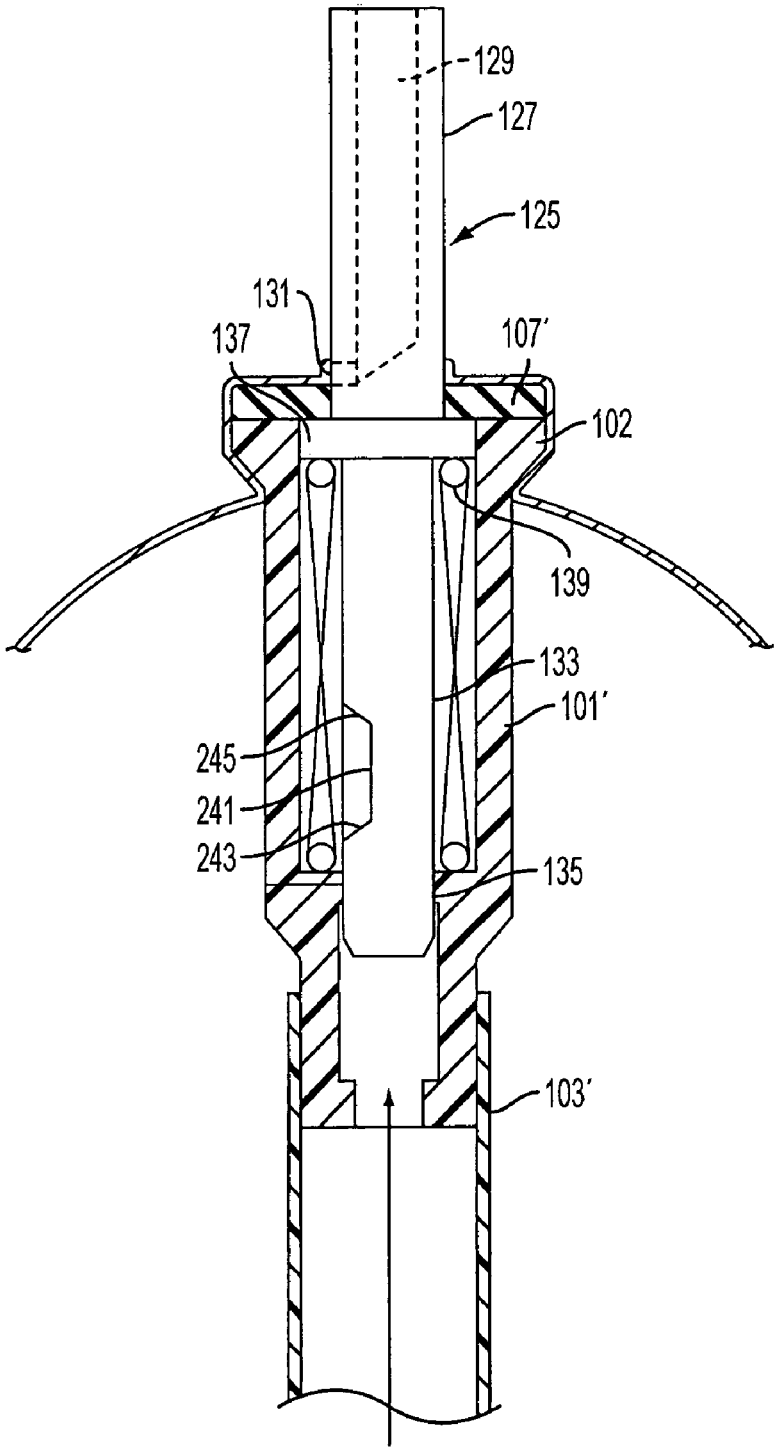
FIG. 7 is a cross-section of a second embodiment of the anti-clog valve of the present invention.

The two piece valve stem in FIGS. 5 and 6 is typically made of metal. The housing in this embodiment may also be of metal. However, for the reasons noted above, i.e., to avoid problems with dissimilar metals, a plastic valve is preferred. Thus, the present invention provides another embodiment of anti-clog dispensing valve for dispensing material from a container, which can be made with a plastic stem, so the whole valve (except for the spring) is made of plastic as shown in FIG. 7. It includes a valve housing 101' having an enlarged annular portion 102 at its outer end and adapted to accept a dip tube 103' at its inner end. A gasket 107' forming a valve seat is disposed at the outer end of annular portion 102 and adapted to be held between the outer end of annular portion 102 and an annular portion of the container to which the valve is attached.

The valve has a plastic stem 125 with an upper cylindrical stem portion 127 with a bore forming a discharge passage 129 and a discharge orifice 131 in its wall leading to discharge passage 129. The upper stem portion 127 extends through gasket 107' with the orifice 131 above the gasket 107' in the unoperated position of the valve. A lower cylindrical stem portion 133 closed at its inner end extends through an inlet seal 135 at the inner end of the housing 101'. An annular flange 137 is provided between the inner end of the upper cylindrical stem portion 127 and the outer end of the lower cylindrical stem portion 133. A spring 139 extends between the inner end of the housing 101' and the annular flange 137, biasing said stem outwardly. In the lower cylindrical stem portion, a bypass passage 241 is formed. The ends of said passage are located so that upon actuation of the valve by pressing inwardly on stem 125, after a first movement, the discharge orifice 131 passes through the gasket 107' into the housing to allow material to be dispensed. After further movement, an inner end 243 of the bypass 241 passes through the seal 135 to permit material to flow into the housing 101' via the inner end 243 and out an outer end 245 of the passage.

This type of valve, in which the tank is sealed off when not dispensing, can also be constructed as a metering valve. If the outer end 245 of passage 241 is located to close off before orifice 131 is opened to the housing 101' this will be the case. As inner end 243 is moved past the seal 135, the housing 101' will fill with material. Then, outer end will close off so the only the material in the housing is available to dispense. Finally, orifice 131 moves past gasket 107 so that only the dose in the housing is dispensed.

Upon release of the stem and return to a rest position by the spring, the bypass 241 closes before the orifice 131 is closed by gasket 107'. As a result, the remaining vapor phase propellant in the pump housing 101' drives out material remaining in the housing 101'. This clears orifice 131 and passageway 129. Subsequently, the orifice passes behind said gasket to terminate dispensing and the housing remains isolated from material in the container until the valve is again operated. Because the remaining pressure in the tank blew out the material in the tank before the outlet orifice was closed, the tank is essentially empty, and the outlet orifice and passageway free of material. As a result, clogging that would otherwise result in a conventional valve is avoided.

Figure 8:
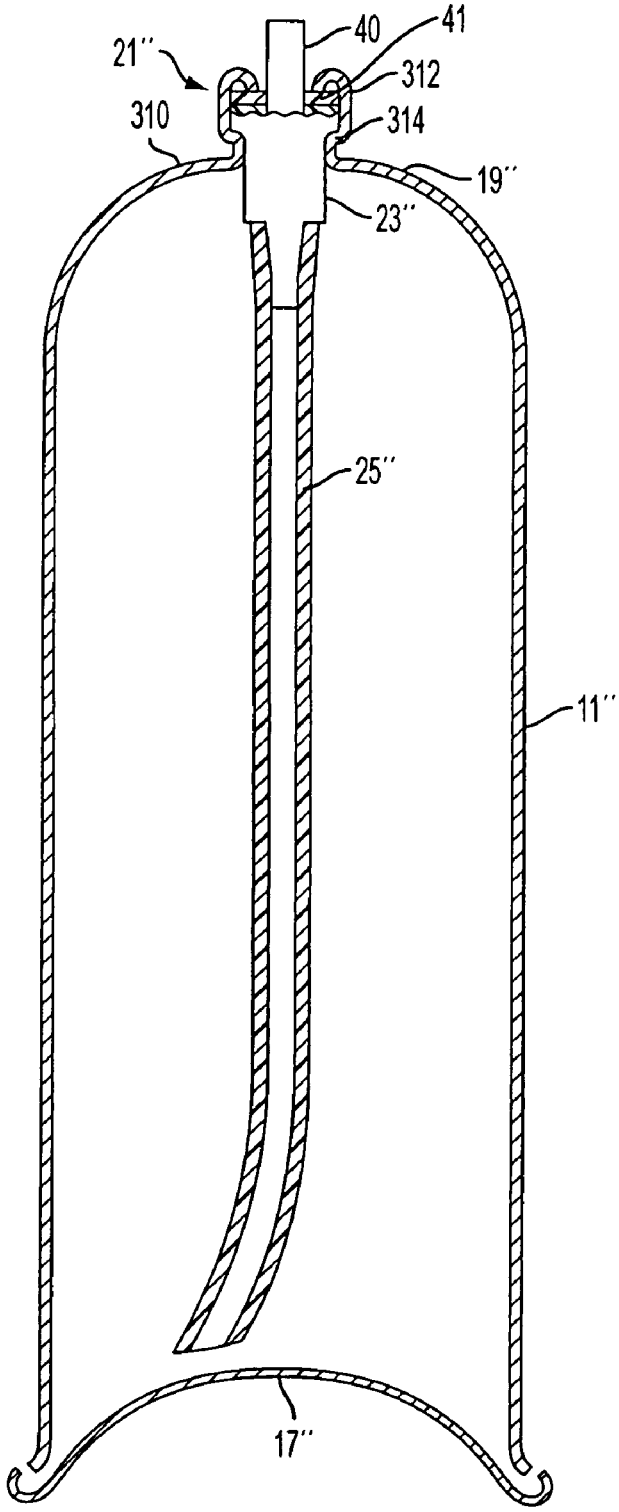
FIG. 8 is a cross-sectional view of a second embodiment of an aerosol container according to the present invention.

FIG. 8 is a cross section of a second embodiment of an aerosol dispenser according to the present invention. The metal drawn can or container 11," like can 11' of FIG. 3 can be fabricated from any available metal that can be drawn, for example, by means of a plunger press typically used in multiple stages for forming a container or receptacle out of aluminum. In the first step, a dome is formed, followed by formation of the mounting cup structure 21," which allows a valve or pump 23" to be inserted from above. The following drawing steps, coating and decorating are as described in connection with FIG. 3. Again, shown separated from the can 11' is the bottom 17" which can be attached with a conventional double seal as in the embodiment of FIGS. 1 and 2.

Figure 9:
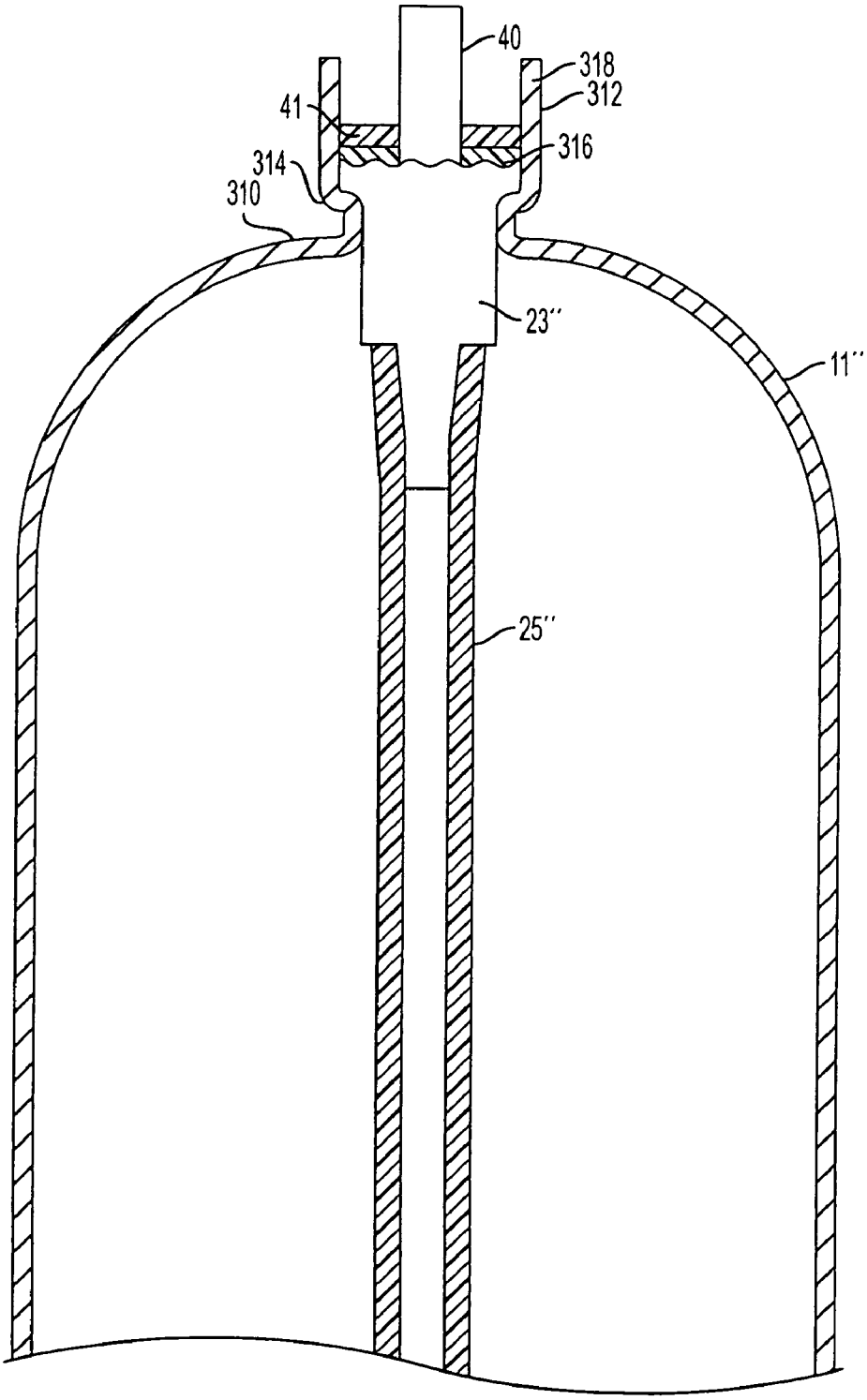
FIG. 9 is a cross-sectional view of the embodiment of FIG. 8 before crimping the outer part of the cylindrical portion into which the valve is inserted.

The top of the can 11", in this case is shaped to accept an aerosol valve 23" (or a pump) inserted from above with a press fit. Thus, at the diameter 19", at about the spot where the prior art had a bead, the dome has a radially inwardly extending portion 310. Extending axially outward from portion 310 is a cylindrical portion 312. Just above the junction between portions 310 and 312, the cylindrical portion is crimped inwardly to form a shoulder 314, better seen in FIG. 9. This structure formed when fabricating the can provides a special opening or built-in mounting cup 21", for allowing aerosol valve 23" to be press fit into the cylindrical portion 312 from above. Valve 23" may be a conventional valve, metered or continuous that can be press fit into the cylindrical portion 312 either by the container supplier or the marketer of the product. In particular, a valve such as that shown in FIG. 6 or 7 may be used. Alternatively, valve 23" may be a finger operated pump. Typically, such valves or pumps are made of plastic, as with the embodiment of FIG. 7 and there is no need to be concerned about their reacting with the metal of the container 11".

Figure 10:
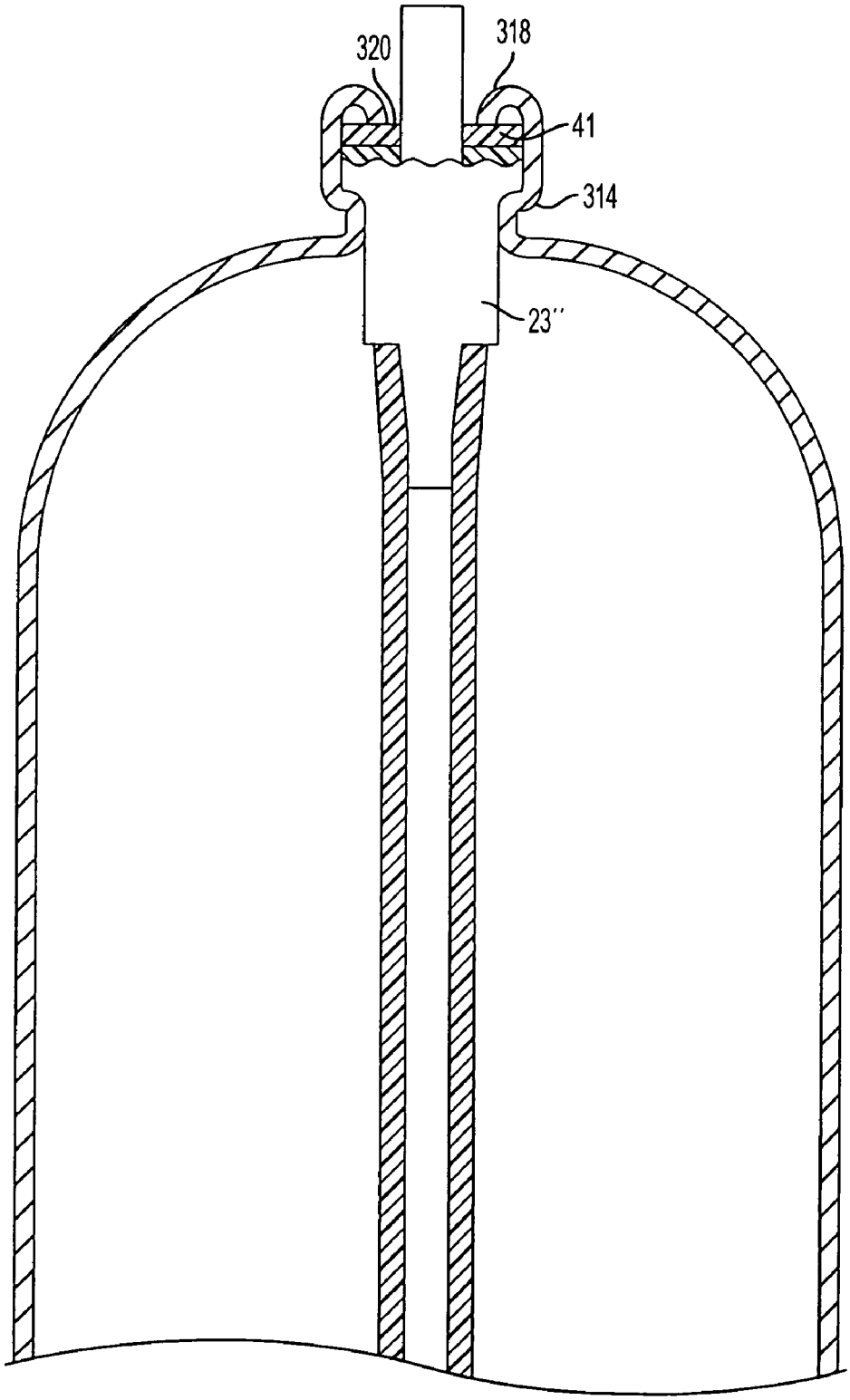
FIG. 10 is a cross-sectional view of the embodiment of FIG. 8 after crimping the outer part of the cylindrical portion into which the valve is inserted.

FIG. 10 shows the valve 23" press fit into the cylindrical portion 312. It is inserted until the enlarged outer portion 316 of the valve abuts against shoulder 314. The valve 23" is held in place by crimping the outer part 318 of portion 312 both radially and axially inwardly so that it abuts the top of the outer portion of the valve 23", with the valve stem 40 extending through the opening 320 remaining.

Figure 11:
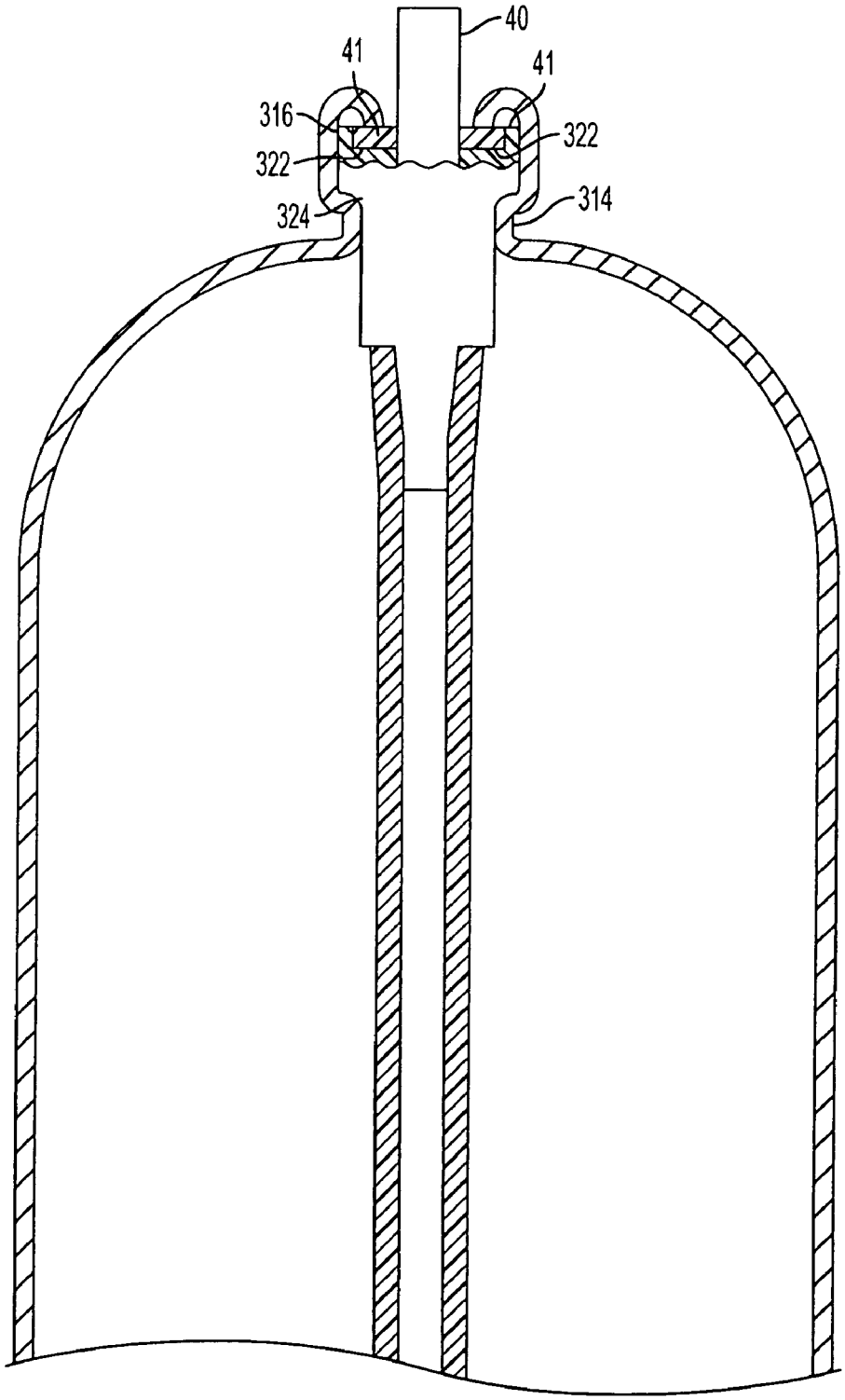
FIG. 11 is a cross-sectional view of the embodiment of FIG. 8 after crimping the outer part of the cylindrical portion into which the valve is inserted in which a gasket is disposed at the top of the valve body.

As shown, for example, in FIG. 11, a gasket 41 may be provided to seal against the stem 40 and also seal against the enlarged outer portion 316 of the valve. In that case the tip of the outer portion will press against the gasket 41. The enlarged outer portion 316 of the valve 23" can be formed with a recess 322 to receive the gasket 41. In addition, a sealant 324 may be provided in the location where the enlarged outer portion 316 of the valve abuts the shoulder 314 to insure no leakage at that point. An actuator of conventional design may be attached to the valve stem 40 to press it axially inwardly to dispense material in the form of a spray from the finished dispenser.

With the construction of the embodiments of FIGS. 8-11, it becomes possible for the container, with bottom attached to be made by the container manufacturer. The container can be filled from the top before insertion of the valve. This is preferable done at the same location, but is also very amenable to filling by a contract filler who need only obtain the container and valve. After filling the container, he need only insert the valve and crimp the end 318 to hold it in place. This would be followed by pressurizing and testing in conventional fashion.

Method of Constructing and Filling

Substantial savings can be achieved if the container manufacturer who fabricates the container body and the bottom closure can assemble the valve in the top of the container that is formed to accept the modular valve, such as the anti-clog valve of FIGS. 5 and 6 or 7. Directly mounting the valve to the container avoids potential leakage due to improper crimping or problems caused by a dissimilar protective coating of the metal mounting cup that occur when using containers with the one inch opening.

The container manufacturer can also perform the filling operation and put the actuator on the valve stem, check for leakage, and pack the finished product into shipping container to meet customer's specifications. The entire dispensing product can be produced under one roof with one manufacturer thereby reducing multiple responsibilities. Substantial savings are achieved by having to issue only one purchase order covering all the elements necessary to meet the customer's needs.

Figure 12:
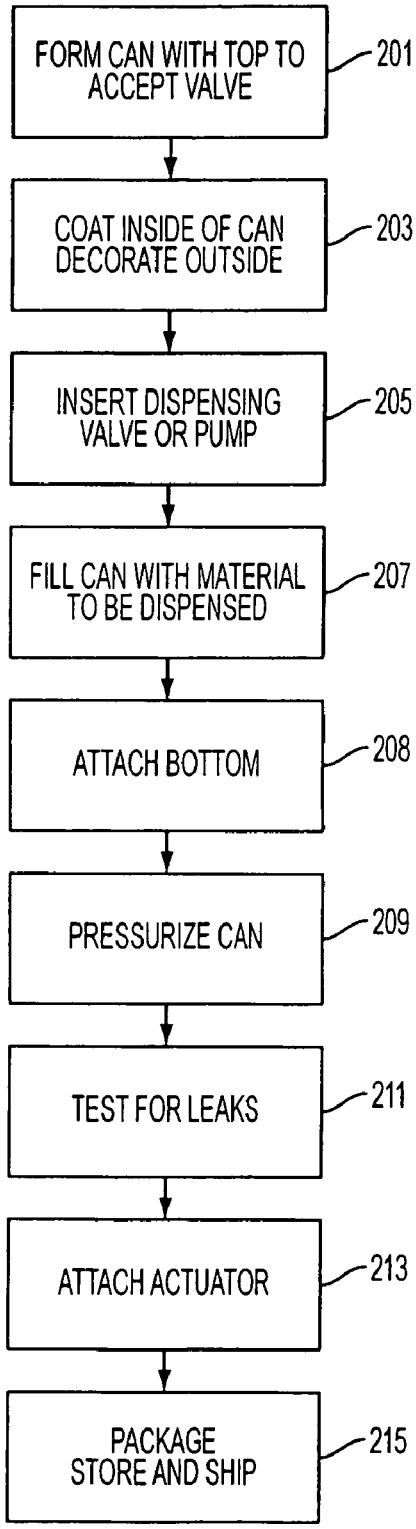
FIG. 12 is a flow chart for a method for efficiently making a container according to the present invention, filling it and assembling it.

Thus, as shown in FIG. 12, at one location, under one roof, first in step 201 the can or container is formed with a structure to accept a valve or pump as shown in FIG. 3. Then in step 203, the inside of the can is coated and the outside decorated by painting, for example. In step 205 a valve or pump is inserted either by snapping in place or crimping into the top of the container 11' of FIG. 3. The can is filled with the material to be dispensed in step 207 and the bottom 17' is then attached in step 208. The can is pressurized in step 209. This can be done by cold filling the propellant in the liquid phase before attaching the bottom or by supplying it via the one way valve 27 of FIG. 3. In step 211, the container is checked for leaks and in step 213 the actuator and any cover is put on the can. Finally the containers are packaged, temporarily stored in inventory and then shipped to buyers in step 215.

Although it is most advantageous to do all operations at one location, there is still an advantage to doing all but container manufacture at the same location, e.g., by a contract filler. In that case steps 201 and 203 would be done by the container manufacturer and the remaining steps of FIG. 12 at another location. The embodiment of FIGS. 8-11 is particularly amenable to contract filling. In the past, with the prior art embodiments of FIGS. 1 and 2, the contract filler needed to crimp the mounting cup in place after filling the container from the top. In the present case, with the embodiment of FIG. 8 he must only insert the valve and crimp it into place after filling from the top. Thus, in terms of the process shown in FIG. 12 the steps 205 and 208 would be interchanged. That is the bottom would be attached before filling and the valve inserted after filling.

These and other modifications can be made without departing from the spirit of the invention, which is intended to be limited solely by the appended claims.

What is claimed is:

1. A method of making and preparing a dispenser comprising performing the following steps:

a. fabricating a metal drawn container with an open bottom and a mounting cup structure integrally formed in a top of the container, wherein the mounting cup structure comprises:

a first, cylindrical axially inwardly extending portion, a second, annular portion extending radially inward from said first portion, a third, cylindrical portion extending axially outward from said second portion, and a fourth, annular portion extending radially inward from said third portion, or wherein the mounting cup structure comprises:

a first radially inwardly extending portion, a second cylindrical portion extending axially outward from said first portion, a junction between said first portion and said second portion, and an inward crimp in said second portion above said junction, wherein said inward crimp forms a shoulder;

b. after the step of fabricating the metal drawn container with the open bottom and the mounting cup structure integrally formed in the top of the container, inserting and crimping a valve in the mounting cup structure in the top of the container with a valve stem projecting through an opening in the top of the container;

c. filling the container with a product to be dispensed; and d. after the step of inserting and crimping the valve in the mounting cup structure in the top of the container, attaching a bottom piece to the container by double sealing.

2. The method of claim 1 wherein said container is made of steel.

3. The method of claim 2 wherein said container is tin plated or coated on the inside of the container with a protective coating to resist corrosion or any reaction with a product to be dispensed.

4. The method of claim 1 further comprising externally decorating said container.

5. The method of claim 1 wherein said bottom piece includes a one-way valve for pressurizing the container.

6. The method of claim 1 wherein said container is made of aluminum.

7. The method of claim 1 further comprising filling said container with a material to be dispensed.

8. The method of claim 7 further comprising pressurizing said container with a gas.

9. The method of claim 1 wherein the mounting cup structure comprises the first radially inwardly extending portion, the second cylindrical portion, the junction, and the inward crimp forming the shoulder, further comprising inserting said valve into said second cylindrical portion from above with a press fit, said valve having an enlarged outer part abutting said shoulder, and crimping an outer end of said second cylindrical portion radially inward to contact said enlarged outer part to hold said dispensing device in place.

10. The method of claim 1 further comprising fitting said bottom piece with a one way valve and admitting a gas through the one-way valve to pressurize the container.

11. The method according to claim 1 wherein all of said steps are performed at one factory location.

12. The method according to claim 11 and further including decorating the outside of the container.

13. The method according to claim 1 and further including, prior to inserting the valve, applying a protective coating to the inside of the container.

14. The method according to claim 1 and further including, after attaching the bottom piece, putting an actuator on the valve stem.

15. The method according to claim 1 and further including pressurizing the filled container; and checking for leakage.

16. The method according to claim 1 and further including packing the finished product into a shipping container.

17. The method of claim 1 wherein the valve is inserted into the mounting cup structure from the bottom of the container.

18. The method of claim 1 wherein the valve is inserted into the mounting cup structure from the top of the container.

19. The method of claim 1 wherein the step of attaching the bottom piece to the container by double sealing takes place after the step of filling the container with a product to be dispensed.

20. A method of making and preparing a dispenser comprising performing the following steps:

a. fabricating a metal drawn container with an open bottom and a mounting cup structure integrally formed in a top of the container, wherein the mounting cup structure comprises:

a first, cylindrical axially inwardly extending portion, a second, annular portion extending radially inward from said first portion, a third, cylindrical portion extending axially outward from said second portion, and a fourth, annular portion extending radially inward from said third portion;

b. after the step of fabricating the metal drawn container with the open bottom and the mounting cup structure integrally formed in the top of the container, inserting and crimping a dispensing device in the mounting cup structure in the top of the container with a valve stem projecting through an opening in the top of the container;

c. filling the container with a product to be dispensed; and d. after the step of inserting and crimping the dispensing device in the mounting cup structure in the top of the container, attaching a bottom piece to the container by double sealing.

21. The method of claim 20, wherein the dispensing device is a pump.

22. A method of making and preparing a dispenser comprising performing the following steps:

a. fabricating a metal drawn container with an open bottom and a mounting cup structure integrally formed in a top of the container, wherein the mounting cup structure comprises:

a first radially inwardly extending portion, a second cylindrical portion extending axially outward from said first portion, a junction between said first portion and said second portion, and an inward crimp in said second portion above said junction, wherein said inward crimp forms a shoulder;

b. after the step of fabricating the metal drawn container with the open bottom and the mounting cup structure integrally formed in the top of the container, inserting and crimping a dispensing device in the mounting cup structure in the top of the container with a valve stem projecting through an opening in the top of the container;

c. filling the container with a product to be dispensed; and d. after the step of inserting and crimping the dispensing device in the mounting cup structure in the top of the container, attaching a bottom piece to the container by double sealing.

23. The method of claim 22, wherein the dispensing device is a pump.

24. A method of making and preparing a dispenser comprising performing the following steps:

a. fabricating a metal drawn container with an open bottom and a mounting cup structure integrally formed in its top, wherein the mounting cup structure comprises:

a first, cylindrical axially inwardly extending portion, a second, annular portion extending radially inward from said first portion, a third, cylindrical portion extending axially outward from said second portion, and a fourth, annular portion extending radially inward from said third portion, or wherein the mounting cup structure comprises:

a first radially inwardly extending portion, a second cylindrical portion extending axially outward from said first portion, a junction between said first portion and said second portion, and an inward crimp in said second portion above said junction, wherein said inward crimp forms a shoulder;

b. crimping a valve in the top of the container with a valve stem projecting through an opening in the top of the container;

c. filling the container with a product to be dispensed;

d. attaching a bottom piece to the container by double sealing; and e. fitting said bottom piece with a one way valve and admitting a gas through the one-way valve to pressurize the container, wherein said valve comprises:

a. a valve housing having an enlarged annular portion at an outer end and adapted to accept a dip tube at an inner end;

b. a gasket forming a valve seat disposed at said outer end and adapted to be held between said outer end and a portion of said mounting cup structure;

c. a stem including:

i. an upper cylindrical stem portion with a central axial bore forming a discharge passage and a discharge orifice in a wall of the upper cylindrical stem portion leading to said discharge passage;

ii. a lower cylindrical stem portion closed at an inner end;

iii. an inlet seal at the inner end of the housing through which the inner end of the lower cylindrical stem portion passes; and iv. an annular flange at an inner end of said upper cylindrical stem portion;

d. a spring extending between the inner end of said housing and said annular flange biasing said stem outwardly; and e. a bypass passage in said lower cylindrical stem portion, the ends of said bypass passage located so that upon actuation of said valve by pressing inwardly on said stem:

after a first movement, said discharge orifice passes through said gasket into said housing;

after further movement an inner end of said bypass passage passes through said inlet seal to permit the material to flow into said housing via said inner end and out an outer end of said bypass passage; and upon release of said stem and return to a rest position by said spring:

i. said bypass passage closes before said discharge orifice is closed by said gasket;

ii. remaining pressure in said valve housing drives out material remaining in said housing, thereby clearing said discharge orifice and discharge passage;

iii. said discharge orifice passes behind said gasket to terminate dispensing; and iv. said housing remains isolated from the material in the container until the valve is again operated.

25. The method of claim 24 wherein:

a. said valve housing and said stem are made of molded plastic; and b. said bypass passage comprises a channel having an inner end and an outer end formed in a surface of the inner end of said lower cylindrical stem portion.

26. A method of making and preparing a dispenser comprising performing the following steps:

a. fabricating a metal drawn container with an open bottom and a mounting cup structure integrally formed in its top, wherein the mounting cup structure comprises:

a first, cylindrical axially inwardly extending portion, a second, annular portion extending radially inward from said first portion, a third, cylindrical portion extending axially outward from said second portion, and a fourth, annular portion extending radially inward from said third portion, or wherein the mounting cup structure comprises:

a first radially inwardly extending portion, a second cylindrical portion extending axially outward from said first portion, a junction between said first portion and said second portion, and an inward crimp in said second portion above said junction, wherein said inward crimp forms a shoulder;

b. crimping a valve in the top of the container with a valve stem projecting through an opening in the top of the container;

c. filling the container with a product to be dispensed; and d. attaching a bottom piece to the container by double sealing, wherein said valve comprises:

a. a valve housing having an enlarged annular portion at an outer end and adapted to accept a dip tube at an inner end;

b. a gasket forming a valve seat disposed at said outer end and adapted to be held between said outer end and a portion of said mounting cup structure;

c. a two piece stem including:

i. an upper stem formed by a hollow cylindrical member with a central axial bore forming a discharge passage and with a discharge orifice in a wall of the upper stem leading to said discharge passage and having an inner end of a smaller diameter than a diameter of an outer end;

ii. a lower hollow cylindrical stem closed at an inner end and having said inner end of said upper stem inserted into and closing an outer end; and iii. said inner end of the lower cylindrical stem passing through an inlet seal at the inner end of the housing;

d. a spring biasing said stem outwardly; and e. a bypass in said lower cylindrical stem portion having inner and outer spaced orifices in said lower cylindrical stem part, said orifices located so that upon actuation of said valve by pressing inwardly on said stem, after a first movement, said discharge orifice passes through said gasket into said housing, after further movement said inner orifice passes through said inlet seal to permit material to flow into said housing via said inner orifice, said lower stem portion, and said outer orifice, and, on release of said stem, said inner orifice becomes sealed by said inlet seal before said discharge orifice is sealed by said gasket, thereby allowing pressure in said housing to flush out the discharge orifice and the discharge passage.

27. The method according to claim 26 wherein said stem is made of metal.

* * * * *